US009449479B2

(12) United States Patent
Rogers

(10) Patent No.: US 9,449,479 B2
(45) Date of Patent: Sep. 20, 2016

(54) SECURITY SYSTEM

(71) Applicant: Colin Rogers, Tavistock (GB)

(72) Inventor: Colin Rogers, Tavistock (GB)

( * ) Notice: Subject to any disclaimer, the term of this patent is extended or adjusted under 35 U.S.C. 154(b) by 0 days.

(21) Appl. No.: 14/574,357

(22) Filed: Dec. 17, 2014

(65) Prior Publication Data

US 2016/0180665 A1 Jun. 23, 2016

(51) Int. Cl.
*G08B 13/14* (2006.01)

(52) U.S. Cl.
CPC ..... *G08B 13/14* (2013.01)

(58) Field of Classification Search
CPC ..... G08B 13/14; G08B 13/1445; G08B 13/1454; G08B 13/1427; G08B 13/126; G08B 13/1409; G08B 13/1463; G08B 13/1961; G08B 21/0227; G08B 21/023; G08B 21/0286; G08B 21/0288; G08B 13/1436; G08B 21/0275; G08B 25/009; G08B 13/08; G08B 13/149; G08B 13/16; G08B 13/196; G08B 13/19645; G08B 21/0263

See application file for complete search history.

(56) References Cited

U.S. PATENT DOCUMENTS

| | | | | |
|---|---|---|---|---|
| 5,446,445 | A | 8/1995 | Bloomfield et al. | |
| 7,126,473 | B1 * | 10/2006 | Powell | G08B 13/1427 340/5.22 |
| 8,111,156 | B2 * | 2/2012 | Song | G08B 13/19647 340/539.22 |
| 8,994,530 | B2 * | 3/2015 | Amis | G08B 13/196 340/541 |
| 2003/0227337 | A1 | 12/2003 | Siniscalchi | |
| 2003/0227377 | A1 | 12/2003 | Cardenas | |
| 2009/0325572 | A1 | 12/2009 | Ji | |
| 2010/0045457 | A1 * | 2/2010 | Krill | G08B 29/188 340/539.22 |
| 2011/0057797 | A1 * | 3/2011 | Parker | G08B 21/22 340/568.1 |
| 2011/0169612 | A1 * | 7/2011 | Alicot | G06K 7/10009 340/10.4 |
| 2011/0175733 | A1 * | 7/2011 | Billiard | G08B 7/06 340/568.1 |
| 2011/0269503 | A1 | 11/2011 | Park et al. | |
| 2012/0223825 | A1 | 9/2012 | DosSantos | |
| 2012/0286951 | A1 | 11/2012 | Hess et al. | |
| 2013/0027201 | A1 * | 1/2013 | Schuller | G08B 13/1472 340/539.13 |
| 2014/0240088 | A1 * | 8/2014 | Robinette | G08B 13/1427 340/5.61 |
| 2015/0029026 | A1 * | 1/2015 | Brandes | A45C 13/18 340/571 |
| 2015/0262461 | A1 * | 9/2015 | Richter | G08B 13/149 340/568.1 |

FOREIGN PATENT DOCUMENTS

| | | |
|---|---|---|
| GB | 2363287 A | 12/2001 |
| IT | 1258669 | 2/1996 |
| NL | 1014393 | 8/2001 |
| WO | 2004/019593 A2 | 3/2004 |

* cited by examiner

*Primary Examiner* — Hirdepal Singh
(74) *Attorney, Agent, or Firm* — Crose Law LLC; Bradley D. Crose

(57) ABSTRACT

Known security systems issue an audible and/or visible alarm to alert all those local to a secured article that the article has been compromised. However, for various reasons, passers-by do not respond to such an alarm/alert. According to the present invention, if an intruder interferes with a secured article, a sensor may detect an event associated with an article being interfered with and/or compromised. This detection will trigger (via a processor) an alarm condition, and a transceiver will send an alarm signal to a monitoring device over a communication network; however, no indication of the alarm condition is detectable outside the housing by means other than via the alarm signal. In this way, an intruder compromising an article is not alerted to detection of the event by the sensor. Therefore, authorities may be summoned to apprehend the intruder without the intruder being provided with the opportunity to escape.

11 Claims, 1 Drawing Sheet

SECURITY SYSTEM

FIELD OF THE INVENTION

The present invention relates generally to a security system and a security device, and a method and apparatus for monitoring and controlling the security device over a communication network. The present invention finds particular, although not exclusive, utility in an alarm system for notifying an operator of the alarm system of an alarmed article being compromised.

BACKGROUND OF THE INVENTION

Systems are known in which security of an article is provided by a device that detects one or more events associated with an article being compromised. In particular, articles to which security may be provided include cars, lorries, construction plants, bicycles, luggage, bags, boxes, caravans, trains, tents, portable buildings, intermodal containers, houses, shops, offices, other buildings, and any other similar construction. An article may be compromised if it is removed and/or accessed without authorisation. In particular, a level of protection may be applied to an article/appliance (such as, for example, a lock and/or tether), and breach of that protection (such as, for example, breaking a lock and/or tether) and/or circumvention of that protection (such as, by accessing the appliance via an un-locked route) would constitute the article being compromised. In certain circumstances, a level of protection may not be applied to an article, whereupon the article may be compromised merely by being accessed and/or moved. Known systems may detect breach and/or circumvention of protection applied to an article, or access or movement of an article.

Known security systems issue an audible and/or visible alarm to alert all those local to the article that the article has been compromised. However, for various reasons, passers-by do not respond to such an alarm/alert. For instance, a high frequency of false and/or nuisance alarms encourage passers-by to ignore audible and/or visible alarms. Furthermore, passers-by may not wish to endanger themselves by investigating an alarm/alert. This is particularly important in remote areas where a driver of an alarmed container lorry may not wish to investigate an alarm without support from other people and/or the authorities (such as the police). In addition, known alarms provide no indication to an observer how long they have been triggered. For instance, a homeowner may return home to find their alarm activated, but has not indication of how long the alarm has been triggered, and is therefore unaware of whether intruders are likely to still be present within the house, or whether local authorities are likely to have already responded to the alarm.

The present invention seeks to overcome these problems.

BRIEF SUMMARY OF THE INVENTION

According to a first aspect of the present invention, there is provided a security system for indicating when an article has been compromised, the system comprising: a security device configured to secure the article; and a monitoring device configured to monitor the security device over a communication network, wherein the monitoring device comprises a controller for controlling operation of the security device over the communication network; wherein the security device comprises: a substantially tamper-proof housing; a power source located within the housing; at least one sensor located within the housing, the at least one sensor configured to detect an event associated with the article being compromised; a processor located within the housing, the processor configured to trigger an alarm condition in response to the at least one sensor detecting an event associated with the article being compromised; and a transceiver located within the housing, the transceiver configured to send an alarm signal to the monitoring device over the communication network in response to triggering of the alarm condition by the processor; and wherein the security device is configured such that the alarm condition is only detectable outside the housing via the alarm signal.

An observer at the security device may only able to detect an alarm condition via the alarm signal, an observer at the security device may not able to detect an alarm condition without access to the communication network, there may be no alarm indication at the security device that passes through the housing, and/or no sound or light may be emitted from the security device in response to the alarm condition.

If an intruder interferes with a secured article, the at least one sensor may detect an event associated with an article being interfered with and/or compromised. This detection will trigger (via the processor) an alarm condition, and the transceiver will send an alarm signal to the monitoring device over the communication network; however, no indication of the alarm condition is detectable outside the housing by any means other than via the alarm signal.

In this way, an intruder compromising an article is not alerted to detection of the event by the sensor. In this way, authorities may be summoned to apprehend the intruder without the intruder being provided with the opportunity to escape. This is particularly important in remote locations, such as quarries or campsites, where if an alarm sounds an intruder will have ample opportunity to escape before authorities, such as the police or a private security service, arrive.

The present invention may operate over any suitable communication network, including: a telecommunication network, a mobile telecommunication network, a GSM network, a public switched telephone network, the internet, an intranet, a local area network, a radio frequency network, a public network, a private network, or any network or combination thereof.

The tamper-proof housing may be robust. In particular, the tamper-proof housing may be configured to resist forced entry by a user and/or by a user operating un-powered hand tools. The tamper-proof housing may comprise a plastic box and/or case.

The at least one sensor may be selected from the group comprising: a motion detector, an acoustic detector, an optical detector, a heat detector, a vibration detector, a trip switch, a GPS system, a gyroscopic detector, an infrared detector, an ultrasonic detector, a microwave detector, a tomographic detector, a laser detector, a jammer detector and any other suitable form of sensor.

An event associated with an article being compromised may be motion within the sensing range of the motion, ultrasound, microwave or tomographic detector, a sound or vibration occurring within the sensing range of an acoustic or vibration detector, a change in light, heat or infrared levels within the sensing range of an optical, heat or infrared detector, a tripping of a trip switch (for instance by an electrical contact being made/released, or a laser beam being crossed), and/or translational and/or rotational movement of the article outside of a pre-determined range, including acceleration.

The security device may comprise at least two sensors. For instance, two sensors, three sensors, four sensors, five sensors or six sensors. One or more of the sensors may be of the same or a different kind to the other sensors.

The security device may comprise a sensitivity adjustment control configured to adjust the sensitivity of the at least one sensor. In this way, the occurrence of nuisance alarms and/or false alarms may be reduced, while preventing circumvention of the security system in a given environment.

The jammer detector may be configured to detect a mobile phone jammer. The processor may be configured to activate a GPS unit in the security device in response to detecting a mobile phone jammer. The monitoring device may be further configured to identify when GPS has been activated on the security device, and may be configured to indicate an alarm condition to a user of the monitoring device in response to such an identification, even if there has been no alarm signal received by the monitoring device over the network. In some embodiments, the security device may be configured to send a modulated GPS signal, wherein modulation to the GPS signal may include data that may include an alarm signal.

The transceiver may comprise a SIM card for communication over a telecommunication network. In this way, existing technology and infrastructure may be relied upon for the operation of the invention.

The transceiver may comprise more than one SIM card, each for communication over a respective telecommunication network, and may additionally comprise a network strength detection switch configured to direct the transceiver to operate over a selected one of the telecommunication networks in response to a detected strength of each telecommunication network. In this way, the transceiver may automatically select a strongest one of the available networks to transmit over, such that contact with the monitoring device is maintained at an optimal level.

The power source may comprise a battery selected from the group comprising a lithium ion battery, a Boston Power long-cycle battery and a Lithonia battery.

The power source may comprise a first power unit and a second power unit, the second power unit being independent from the first power unit. For instance, the first and second power units may both supply power to the transceiver, the sensor and the processor, wherein failure of one of the first and second power units does not affect operation of the other of the first and second power units. The power source may comprise more than two independent power units.

The security device may comprise a power source status detector configured to detect the status of the power source. In particular, the power source status detector may detect the status of each power unit. The power source status detector may be configured to selectively determine which power unit to use to power each component of the security device.

The transceiver may be further configured to send operational data representing a functional status of the security device, and/or sensor data representing an environment of the security device, over the communication network to the monitoring device. Operational data may include power source status data, sensor status data (for example data indicating what they are sensing and/or whether they are functioning correctly), network strength detection switch data, network strength data, alarm status data, unique identifier code data, alert control data, and/or configuration data, amongst other forms of data. Configuration data may include data indicating adjustment of the sensitivity of the at least one sensor, data indicating whether the alarm signal is sent to one or more monitoring devices, the authorities (e.g. police or private security service), a sequence of monitoring devices/telephone numbers, and a hierarchy of backup numbers to use if one in such a sequence is not functioning, data indicating a setting of whether to perform sensing with the sensors and/or determine power status continuously, only on request, intermittently (e.g. every 1 min, 2 min, 5 min or 10 min), and/or only when another sensor is tripped, data indicating a frequency at which to send operational/functional data, for instance on request, intermittently (including the length of the intermission), only after an alarm is tripped, and/or when battery low, etc.

The sensor may detect in a sensing region. The sensing region may be the environment around the sensor.

The transceiver may be further configured to receive control data from the monitoring device, to control operation of the security device. Control data may include configuration data and/or operational data. The control data may comprise instructions to the security device to produce an alarm condition (for example to test the system or security device), and/or to send operational data.

The control data may comprise instructions to the security device to send operational data representing a functional status of the security device, and/or sensor data representing an environment of the security device, over the communication network to the monitoring device.

The control data may comprise configuration data, for configuring operation of the security device.

The transceiver may be configured to communicate with the monitoring device over the communication network using a message selected from the group comprising a telephone call, a radio frequency signal, an email, an SMS and any other message form.

The security device may comprise an attachment mechanism. For example, the security device may comprise mounting brackets, through-holes, clamps and/or other fixing means. In one embodiment, the attachment mechanism may comprise a mounting plate, in which the mounting plate may be configured to mount upon a plurality of bars and/or rods embedded into a wall. For instance, there may be two, three, four or more bars. The bars may be inserted into pre-drilled holes in a wall, such as a concrete wall. The bars may be glued into place.

The housing may prevent user interface by any means other than via the transceiver. In this way, the opportunity for tampering with the security device is reduced. For instance, there may be no user interface device at the security device.

The housing and/or other component parts of the security device may be made from a plastics material, a polycarbonate material, carbon fibre, Kevlar (RTM), metal, another similar material, and/or a combination thereof.

The security device may have a tamper evident construction. Two or more component parts of the security device may be bonded together such that separation of the component parts may release a chemical that may destroy one or more component parts of the security device. In this way, the security device may be invulnerable to tampering, in particular, without tampering being identified.

The system may comprise more than one security device. In this way multiple security devices may secure a single article and/or multiple articles may be secured, each with an associated respective security device. Furthermore, each security device may be monitored and/or controlled by a single monitoring device. A monitoring device may be paired with more than one security device.

Each security device may be provided with a respective unique identifier code detectable by the monitoring device. In this way, it is possible for a monitoring device to distinguish between security devices that it is monitoring.

The system comprises a primary security device and at least one satellite security device, wherein the at least one satellite security device comprises: a substantially tamper-proof satellite housing; a satellite power source located within the satellite housing; at least one satellite sensor located within the satellite housing, the at least one satellite sensor configured to detect an event associated with the article being compromised; a satellite processor located within the satellite housing, the satellite processor configured to trigger a satellite alarm condition in response to the at least one satellite sensor detecting an event associated with the article being compromised; and a satellite transceiver located within the satellite housing, the satellite transceiver configured to send a satellite alarm signal to the security device in response to triggering of the satellite alarm condition by the satellite processor; and wherein the satellite security device is configured such that the satellite alarm condition is only detectable outside the satellite housing via the satellite alarm signal. In this way, the satellite device may communicate with the security device, and the security device may relay such communications to/from the monitoring device.

Each component part of the satellite security device may be the same as a corresponding part of the security device. Alternatively, the component part(s) may differ. In particular, the satellite power source may be substantially smaller than the power source, for instance the satellite power source may be a hearing aid battery. The satellite transceiver may be substantially smaller than the transceiver, for instance the satellite transceiver may be a micro-transceiver; in particular, the micro-transceiver may be a radio transmitter having a range of up to 100 m, 200 m, 500 m, 1 km, 2 km or 2.2 km. The micro-transceiver may operate over a Digital Enhanced Cordless Telecommunications (DECT) system. The micro-transceiver may be configured to encrypt/decrypt communications. The micro-transceiver may be configured to embed an identification signal within communications. The alarm signal may be a GPS signal. In this way, when an article is compromised, the satellite security device may relay its location to the primary security device such that, even if the primary security device is removed from the article being compromised, the location of the article may be determined by the monitoring device such that assistance may be summoned.

The satellite security device may be a substantially flat and/or self-adhesive strip, and may be black in colour, or may have a colour to match the article to be secured. In this way, the satellite security device may be hidden on the article to be secured.

The system may comprise more than one monitoring device. In this way, multiple users may monitor a single security device such that the chance of break-down of security at the human interface level is minimised.

The monitoring device may be selected from the group comprising a computer, a tablet computer, a smartphone, a telephone and a mobile phone, or may be a generic computing device.

The monitoring device may be configured to have a predetermined alarm sound for alerting a user to an alarm condition at the security device.

The monitoring device may be configured to run an application for monitoring and/or controlling the security device, and may have a user interface comprising drop-down menu navigation.

The monitoring device may be configured to log monitored activity of the security device. In this way, the monitoring device may keep a record of some or all activity of the security device, for instance in the form of an electronic activity log. The log may include details of the location of the security device, power levels, dates and/or times when batteries were last changed, and/or dates and/or times when the security device was activated and/or deactivated. In this way, traceability of the security device may be improved by providing a history of the security devices activity. Further, insurance companies may be able to use the log in calculating pay outs.

According to a second aspect of the present invention, there is provided a method of indicating when an article has been compromised comprising the steps of: providing a system according to the foregoing aspect; detect, with the at least one sensor, an event associated with an article being compromised; triggering, with the processor, an alarm condition in response to the at least one sensor detecting an event associated with the article being compromised; and sending, with the transceiver, an alarm signal to the monitoring device over the communication network in response to triggering of the alarm condition by the processor, such that the alarm condition is only detectable outside the housing via the alarm signal; monitoring the security device over the communication network; and controlling operation of the security device over the communication network.

According to a third aspect of the present invention there is provided a security device for use in the system of the first aspect.

According to a fourth aspect of the present invention, there is provided a monitoring device for use in the system of the first aspect.

According to a fifth aspect of the present invention, there is provided a method of operating the monitoring device of the fourth aspect comprising the steps of: providing a monitoring device according to the fourth aspect, monitoring and controlling a security device according to the third aspect, over a communication network.

According to a sixth aspect of the present invention, there is provided a computer program product comprising computer program code adapted to perform all the steps of the method according to the fifth aspect when said program is run on a computer.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
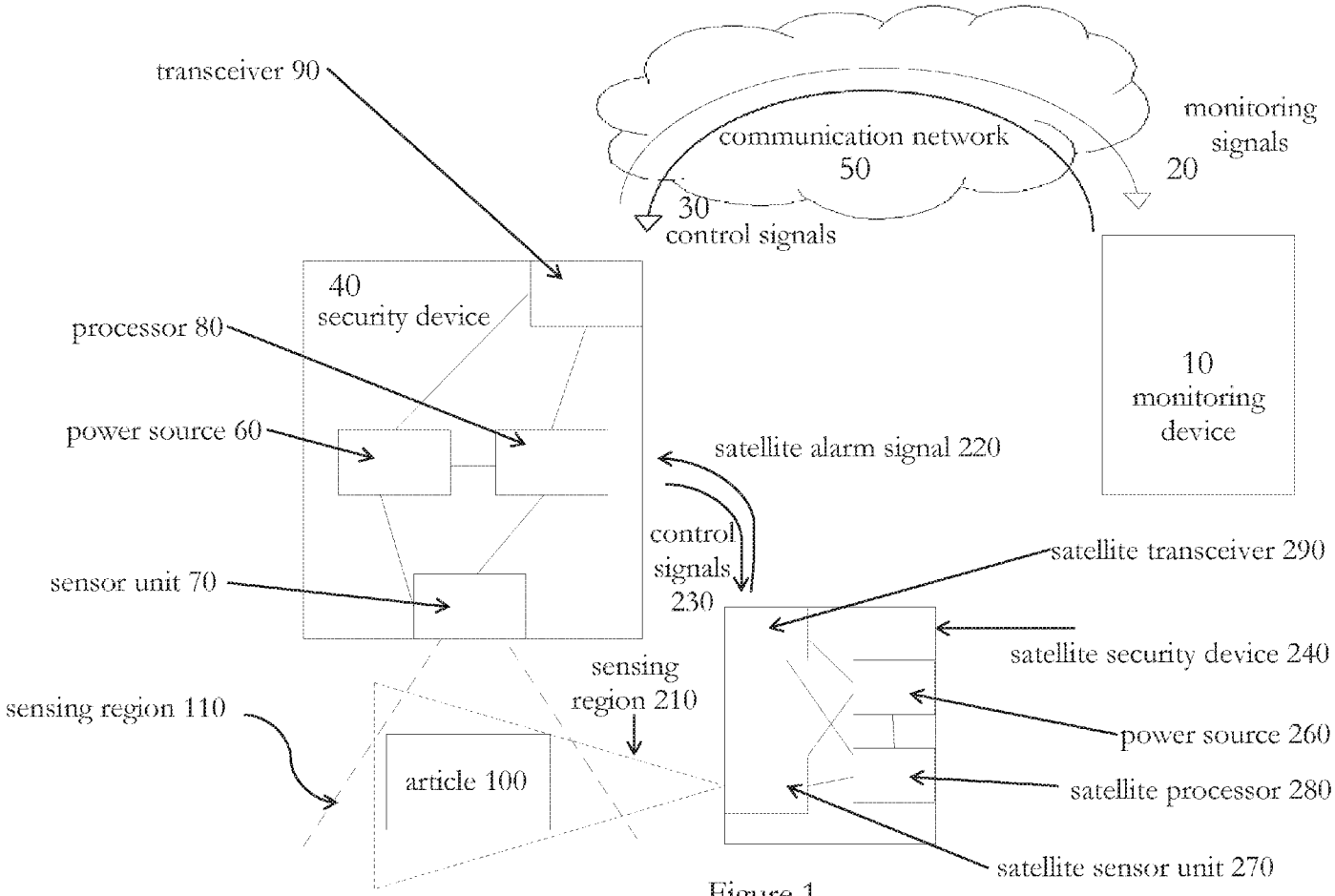
FIG. 1 is a schematic representation of a system according to the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Thus, the scope of the expression "a device A connected to a device B" should not be limited to devices or systems wherein an output of device A is directly connected to an input of device B. It means that there exists a path between an output of A and an input of B which may be a path including other devices or means. "Connected" may mean that two or more elements are either in direct physical or electrical contact, or that two or more elements are not in direct contact with each other but yet still co-operate or interact with each other.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may refer to different embodiments. Furthermore, the particular features, structures or characteristics of any embodiment or aspect of the invention may be combined in any suitable manner, as would be apparent to one of ordinary skill in the art from this disclosure, in one or more embodiments.

Similarly, it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may, in some embodiments, mean only one.

The invention will now be described by a detailed description of several embodiments of the invention. It is clear that other embodiments of the invention can be configured according to the knowledge of persons skilled in the art without departing from the underlying concept or technical teaching of the invention, the invention being limited only by the terms of the appended claims.

FIG. 1 is a schematic representation of a system according to the present invention. A monitoring device 10 monitors (via monitoring signals 20) and controls (via control signals 30) a security device 40 over a communication network 50.

In one embodiment, the monitoring device 10 is a smartphone 10 running an application that enables monitoring 20 and controlling 30 of the security device 40 over a GSM network 50.

The security device 40 contains a power source 60 in the form of two independent batteries. The power source 60 is configured such that, should one battery fail, the other battery can adequately supply the power needs of the security device 40, and specifically, the sensor unit 70, the processor 80 and the transceiver 90.

The security device 40 is located adjacent an article 100. In the present embodiment, the security device 40 is coupled to the article 100 to prevent disassociation of the security device 40 from the article 100; however, other arrangements are also envisaged. The coupling between the security device 40 and the article 100 is not shown, for clarity.

The sensor unit 70 comprises a motion sensor, a vibration sensor and a GPS device. In the figure, the motion sensor has a sensing region 110 that encompasses the article 100; however, in reality, the sensing region 110 may only encompass a portion of the article, for instance a driving seat of a construction plant.

While the security device is active, the motion and vibration sensors are continuously sensing for movement and vibration, respectively. If motion is detected by the motion sensor in the sensing region 110, the motion sensor sends a signal to the processor 80 indicative of a person present in the driving seat of the construction plant. If vibration is detected by the vibration sensor, the vibration sensor sends a signal to the processor 80 indicative of movement of the construction plant, for instance by being hoisted onto a trailer. The combination of signals from the motion and vibration sensors causes the processor 80 to transition to an alarm state.

A satellite security device 240 contains a power source 260, a satellite sensor unit 270, a satellite processor 280 and a satellite transceiver 290. The satellite security device 240 is also located adjacent to the article 100. In the present embodiment, the satellite security device 240 is coupled to the article 100 to prevent disassociation of the satellite security device 240 from the article 100; however, other arrangements are also envisaged. The coupling between the satellite security device 240 and the article 100 is not shown, for clarity.

The satellite sensor unit 270 may be similar to the sensor unit 70. IN fact, the satellite security device 240 may be substantially similar to the primary security device 40. In the figure, the satellite sensor 270 has a sensing region 210 that encompasses the article 100; however, in reality, the sensing region 210 may only encompass a portion of the article, for instance a driving seat of a construction plant.

If the article 100 is compromised, the satellite sensor 270 sends a signal to the processor 280. In turn, the satellite processor 280 transitions to an alarm state, and causes the satellite transceiver to send a satellite alarm signal 220 to the primary security device 40, which in turn causes the processor 80 to transition to an alarm state. In some embodiments, control signals 230 may be sent to the satellite security device.

Once the alarm state is triggered by the processor 80, the processor 80 activates the GPS device. The GPS device had hitherto been inactive to save power. A location of the security device, and therefore the appliance, can be forwarded 20 to the monitoring device 10, via the communication network 50, by the transceiver 90, together with an alarm signal.

In response to receiving the alarm signal at the monitoring device 10, the monitoring device 10 will issue an audible alarm to an operator, in this embodiment in the form of a unique ringtone alarm. The monitoring device 10 will also provide an indication of the location, determined by the GPS device, of the article 100.

Optionally, the transceiver may send an alarm signal directly to the local police service, or additional monitoring devices; however, for simplicity this has been omitted from FIG. 1.

The GPS device may continue to transmit 20 location data to the monitoring device 10 at, for instance, five minute intervals until the GPS device receives 30 an instruction from the monitoring device 10 to stop. The processor will continue in the alarm state until it is reset by the monitoring device 10. Alternatively, the processor may discontinue the alarm state as soon as detection of movement and/or vibration by the movement sensor and the vibration sensor has ceased.

What is claimed is:

1. A security system for indicating when an article has been compromised, the system comprising:

a primary security device configured to secure the article;

at least one satellite security device; and a monitoring device configured to monitor the primary security device over a communication network, wherein the monitoring device comprises a controller for controlling operation of the primary security device over the communication network;

wherein the primary security device comprises:

a substantially tamper-proof housing;

a power source located within the housing;

at least one sensor located within the housing, the at least one sensor configured to detect an event associated with the article being compromised;

a processor located within the housing, the processor configured to trigger an alarm condition in response to the at least one sensor detecting an event associated with the article being compromised; and a transceiver located within the housing, the transceiver configured to send an alarm signal to the monitoring device over the communication network in response to triggering of the alarm condition by the processor; and wherein the housing prevents user interface by any means other than via the transceiver;

wherein the primary security device is configured such that the alarm condition is only detectable outside the housing via the alarm signal;

wherein the at least one satellite security device comprises:

a substantially tamper-proof satellite housing;

a satellite power source located within the satellite housing, the satellite power source being substantially smaller than the power source of the primary security device;

at least one satellite sensor located within the satellite housing, the at least one satellite sensor configured to detect an event associated with the article being compromised;

a satellite processor located within the satellite housing, the satellite processor configured to trigger a satellite alarm condition in response to the at least one satellite sensor detecting an event associated with the article being compromised; and a satellite micro-transceiver located within the satellite housing, the satellite micro-transceiver being substantially smaller than the transceiver of the primary security device, the satellite micro-transceiver configured to send a satellite alarm signal only to the primary security device in response to triggering of the satellite alarm condition by the satellite processor;

wherein the satellite security device is configured such that the satellite alarm condition is only detectable outside the satellite housing via the satellite alarm signal; and wherein the primary security device is configured to relay the satellite alarm signal to the monitoring device.

2. The system of claim 1, wherein the primary security device comprises at least two sensors.

3. The system of claim 1, wherein the primary security device comprises a sensitivity adjustment control configured to adjust the sensitivity of the at least one sensor.

4. The system of claim 1, wherein the transceiver comprises more than one SIM card, each for communication over a respective telecommunication network, and a network strength detection switch configured to direct the transceiver to operate over a selected one of the telecommunication networks in response to a detected strength of each telecommunication network.

5. The system of claim 1, wherein the power source of the primary security device comprises a first power unit and a second power unit, the second power unit being independent from the first power unit.

6. The system of claim 1, wherein the primary security device comprises a power source status detector configured to detect the status of the power source.

7. The system of claim 1, wherein the transceiver of the primary security device is further configured to send operational data representing a functional status of the primary security device, and/or sensor data representing an environment of the primary security device, over the communication network to the monitoring device.

8. The system of claim 1, wherein the transceiver of the primary security device is further configured to receive control data from the monitoring device, to control operation of the primary security device.

9. The system of claim 8, wherein the control data comprises instructions to the primary security device to produce an alarm condition.

10. The system of claim 8, wherein the control data comprises instructions to the primary security device to send operational data representing a functional status of the primary security device, and/or sensor data representing an environment of the primary security device, over the communication network to the monitoring device.

11. A method of indicating when an article has been compromised, the method comprising the steps of:

providing a security system, the security system comprising:

a primary security device configured to secure the article;

at least one satellite security device; and a monitoring device configured to monitor the primary security device over a communication network, wherein the monitoring device comprises a controller for controlling operation of the primary security device over the communication network;

wherein the primary security device comprises:

a substantially tamper-proof housing;

a power source located within the housing;

at least one sensor located within the housing, the at least one sensor configured to detect an event associated with the article being compromised;

a processor located within the housing, the processor configured to trigger an alarm condition in response to the at least one sensor detecting an event associated with the article being compromised; and a transceiver located within the housing, the transceiver configured to send an alarm signal to the monitoring device over the communication network in response to triggering of the alarm condition by the processor; and wherein the housing prevents user interface by any means other than via the transceiver;

wherein the primary security device is configured such that the alarm condition is only detectable outside the housing via the alarm signal;

wherein the at least one satellite security device comprises:

a substantially tamper-proof satellite housing;

a satellite power source located within the satellite housing, the satellite power source being substantially smaller than the power source of the primary security device;

at least one satellite sensor located within the satellite housing, the at least one satellite sensor configured to detect an event associated with the article being compromised;

a satellite processor located within the satellite housing, the satellite processor configured to trigger a satellite alarm condition in response to the at least one satellite sensor detecting an event associated with the article being compromised; and a satellite micro-transceiver located within the satellite housing, the satellite micro-transceiver being substantially smaller than the transceiver of the primary security device, the satellite micro-transceiver configured to send a satellite alarm signal only to the primary security device in response to triggering of the satellite alarm condition by the satellite processor;

wherein the satellite security device is configured such that the satellite alarm condition is only detectable outside the satellite housing via the satellite alarm signal; and wherein the primary security device is configured to relay the satellite alarm signal to the monitoring device;

detecting, with the at least one satellite sensor, the event associated with the article being compromised;

triggering, with the satellite processor, the satellite alarm condition in response to the at least one satellite sensor detecting the event associated with the article being compromised;

sending, with the satellite micro-transceiver, the satellite alarm signal to the primary security device in response to triggering of the satellite alarm condition by the satellite processor, such that the satellite alarm condition is only detectable outside the housing via the alarm signal;

triggering, with the processor, the alarm condition in response to receiving the satellite alarm signal;

sending, with the transceiver, the alarm signal to the monitoring device over the communication network in response to triggering of the alarm condition by the processor, such that the alarm condition is only detectable outside the housing via the alarm signal;

monitoring the primary security device over the communication network; and controlling operation of the primary security device over the communication network.

* * * * *